US012329299B2

(12) United States Patent
Lin

(10) Patent No.: US 12,329,299 B2
(45) Date of Patent: Jun. 17, 2025

(54) ROTARY GOBLET

(71) Applicant: Guopei Lin, Jiangmen (CN)

(72) Inventor: Guopei Lin, Jiangmen (CN)

( * ) Notice: Subject to any disclaimer, the term of this patent is extended or adjusted under 35 U.S.C. 154(b) by 0 days.

(21) Appl. No.: 18/540,769

(22) Filed: Dec. 14, 2023

(65) Prior Publication Data

US 2025/0120525 A1 Apr. 17, 2025

(30) Foreign Application Priority Data

Jun. 5, 2023 (CN) ..... 202321415452.7
Oct. 13, 2023 (CN) ..... 202322764979.7

(51) Int. Cl.
*A47G 19/22* (2006.01)

(52) U.S. Cl.
CPC ..... *A47G 19/2255* (2013.01)

(58) Field of Classification Search
CPC ..... A47G 19/2255; A47G 19/2227; A47G 19/2205
USPC ..... 220/703
See application file for complete search history.

(56) References Cited

U.S. PATENT DOCUMENTS 4,236,428 A * 12/1980 Feamster, III ..... B23B 3/24 82/128
6,491,183 B1 * 12/2002 Huang ..... A47G 19/2266 220/636
2014/0054304 A1 * 2/2014 Hu ..... A47G 19/2255 220/630
2018/0367713 A1 * 12/2018 Gilbert ..... H04N 23/54
2021/0109423 A1 * 4/2021 Ramones ..... F16M 13/02

* cited by examiner

*Primary Examiner* — Stephen J Castellano
(74) *Attorney, Agent, or Firm* — Hemisphere Law, PLLC; Zhigang Ma

(57) ABSTRACT

A rotary goblet is provided, it comprises a goblet body and a base, a bottom of the goblet body is connected to a connecting rod, a bearing is mounted at a top of the base, an inner side of the inner ring of the bearing is provided with a internal thread, and an outer side of a bottom of the connecting rod is provided with a external thread corresponding to the internal thread, and the bottom of the connecting rod is screwed connected to the inner side of the inner ring of the bearing; a connecting seat is mounted at the bottom of the goblet body, an internal threaded hole is provided on an inner side of the connecting seat, and a threaded column corresponding to the internal threaded hole is provided at a top of the connecting rod. The top of the base is provided with a mounting hole for positioning and mounting of the bearing. The rotary goblet in the present disclosure is simple in structure, smooth in placement, smooth in rotation and stable in rotation. When it is necessary to shake the liquid in the goblet body, the rotary goblet can realize that the rotary goblet is rotated on the desktop to wake up the wine automatically. The goblet body can also be placed flat on the desktop as a normal goblet, which can be used for both purposes and meets the diverse needs of users. It is easy to operate, easy to use, the consumer experience is good.

4 Claims, 9 Drawing Sheets

ROTARY GOBLET

TECHNICAL FIELD OF THE INVENTION

The present disclosure relates to the technical field of goblet, in particular to a rotary goblet.

BACKGROUND OF THE INVENTION

Domestic red wine culture is very prosperous, not only for beauty, but also for promoting blood circulation and warming the body, delaying aging, a goblet is commonly used, the bottom surface of the base is usually flat, but red wine needs to be woken up before drinking, the flat bottom of the goblet used to fill the liquid need to be manually to shake the liquid in the goblet in order to play the role of waking up, manually to wake up not only causes fatigue, but also will occupy the activities of a hand, which will cite the inconvenience of use, and the user experience is too monotonous. Later, a wine glass that can be automatically rotated appeared on the market, and a raised support is provided at the bottom center of the goblet so that the goblet can be automatically rotated with the raised support as a center, but in this rotating method, the goblet is slightly tilted, and if the force is more violent, the goblet can be tilted, and the consumer experience is not good. Therefore, in order to avoid the drawbacks existing in the prior art, it is necessary to make improvements to the prior art.

SUMMARY OF THE INVENTION

An object of the present disclosure is to overcome the drawbacks and deficiencies in the prior art, and provide a rotary goblet with a simple structure and easy to use.

The present disclosure is realized by the following technical solutions:

As an aspect of the present disclosure, there is provided a rotary goblet (or rotating goblet, or rotary wineglass) comprising a goblet body and a base, the bottom of the goblet body is connected to a connecting rod, a bearing is mounted at the top of the base, and the bottom of the connecting rod is connected to an inner side of an inner ring of the bearing.

Optionally, a connecting seat is mounted at the bottom of the goblet body, an internal threaded hole is provided on the inner side of the connecting seat, and a threaded column corresponding to the internal threaded hole is provided at the top of the connecting rod.

Optionally, the bearing is affixed to the top of the base;

and/or, the inner side of the inner ring of the bearing is provided with a internal thread and the outer side of the bottom of the connecting rod is provided with a external thread corresponding to the internal thread;

and/or, the top of the base is provided with a mounting hole for positioning and mounting of the bearing;

and/or, the bottom of the inner ring of the bearing and the bottom of the base both are provided with corresponding mounting and positioning holes;

and/or, the top of the connecting rod is provided with an upper support portion that is progressively larger from the bottom to the top;

and/or, the bottom of the connecting rod is provided with a lower support portion that gradually becomes larger from top to bottom;

and/or, the bottom of the base is provided with a non-slip pattern.

Optionally, the connecting seat is affixed to the bottom of the goblet body;

and/or, the connecting seat is a metal connecting seat and the connecting rod is a metal connecting rod.

As another aspect of the present disclosure, there is provided a rotary goblet comprising a goblet body, a lower connecting seat and a base, the bottom of the goblet body is connected to a connecting rod, no less than two bearings are mounted on the inner side of the base, the bottom of the lower connecting seat is connected to the inner ring of the bearings, and the bottom of the connecting rod is connected to the top of the lower connecting seat.

Optionally, the bottom of the goblet body is fitted with an upper connecting seat connected to the connecting rod.

Optionally, an inner side of the upper connecting seat is provided with an upper connecting seat internal threaded hole, and the top of the connecting rod is provided with an upper threaded column corresponding to the upper connecting seat internal threaded hole;

and/or, the upper connecting seat is affixed to the bottom of the goblet body;

and/or, the top of the upper connecting seat is provided with a top opening;

and/or, a number of light-transmitting holes are provided on the outer side of the upper connecting seat, the light-transmitting holes are fitted with light-transmitting decorative members;

and/or, the inner side of the connecting rod is hollow, and the top of the connecting rod is provided with a mounting groove for the light bead to be mounted.

Optionally, the bearing is affixed to the inner side of the base;

and/or, the bottom of the lower connecting seat is provided with a connecting screw rod, the inner side of the inner ring of the bearing is provided with an internal thread corresponding to the connecting screw rod, the connecting screw rod is screwed to the inner side of the inner ring of the bearing, and the top of the lower connecting seat is provided with internal threads of the lower connecting seat;

and/or, the inner side of the base is provided with mounting holes for positioning and mounting of the bearing;

and/or, the bottom of the base is provided with a non-slip pattern.

Optionally, a generator is mounted on the inner side of the bottom of the connecting rod, the generator shaft of the generator is connected to the base, and a light bead electrically connected to the generator is mounted on the top of the connecting rod.

Optionally, a generator shaft mounting hole is provided in a lower portion of the base for the generator shaft of the generator to be fixedly mounted.

As another aspect of the present disclosure, there is provided a rotary goblet characterized in that it comprises a goblet body, an upper connecting rod, a lower connecting rod and a base, the top of the upper connecting rod is connected to the bottom of the goblet body, the bottom of the lower connecting rod is connected to the top of the base, the bottom of the upper connecting rod is provided with a sleeve column, the outside of the sleeve column is sleeved provided with not less than two bearings, the top of the lower connecting rod is provided with sleeve holes for the bearings to be mounted, the outer ring of the bearings is fixedly connected to the top of the lower connecting rod, the inner ring of the bearings is fixedly connected to the sleeve column, and an upper connecting seat connected to the upper connecting rod is mounted at the bottom of the goblet body.

Optionally, a sleeve is provided between the bearings, and the bottom of the sleeve column is snap-fitted with a card spring pressed against the bearings;

and/or, an upper connecting seat internal threaded hole is provided on the inner side of the upper connecting seat and an upper threaded column corresponding to the upper connecting seat internal threaded hole is provided on the top of the upper connecting rod;

and/or, the outer side of the upper connecting seat is provided with a number of light transmitting holes, the light transmitting holes are fitted with light transmitting decorative members;

and/or, the bottom of the base is provided with a non-slip pattern.

Optionally, the bottom of the lower connecting rod is screwed with a lower connecting seat, the top of the lower connecting seat is provided with a lower connecting seat internal thread, and the bottom of the lower connecting rod is provided with a lower threaded column corresponding to the lower connecting seat internal thread.

Optionally, the bottom of the lower connecting seat is provided with a connecting screw rod, the top of the base is provided with a base internal threaded hole corresponding to the connecting screw rod, and the lower connecting seat is screwed to the base.

Optionally, a generator is mounted on the inner side of the bottom of the upper connecting rod, the generator shaft of the generator is connected to the lower connecting rod, a light bead electrically connected to the generator is mounted on the top of the upper connecting rod, and the top of the upper connecting seat is provided with an opening.

Optionally, the upper part of the lower connecting rod is provided with a generator shaft mounting hole for fixedly mounting the generator shaft of the generator;

and/or, the inner side of the upper connecting rod is hollow and the top of the upper connecting rod is provided with a mounting groove for mounting the light bead.

Optionally, the inner side of the upper connecting rod is hollow, and the top of the upper connecting rod is provided with a mounting groove for mounting the light bead.

Relative to the prior art, in the present disclosure the top of the base is provided with a bearing, the inner side of the inner ring of the bearing is provided with internal threads, the outer side of the bottom of the connecting rod is provided with external threads corresponding to the internal threads, and the bottom of the connecting rod is screwed to the inner side of the inner ring of the bearing, so that the connecting rod and the goblet body can be rotated together, and when it is necessary to shake the liquid in the goblet body, the goblet is rotated and the inertia is utilized to realize that the goblet is rotated on the desktop to wake up the wine automatically. The goblet does not need to be tilted to achieve the effect of an automatic rotation of the goblet. By hard rotation of the goblet, there will be no goblet tipping situation, and the goblet is simple in structure, smooth in placement, smooth in rotation and stable in rotation, the goblet body can also be placed flat on the desktop as a normal goblet, which can be used for both purposes and meets the diverse needs of users. It is easy to operate, easy to use, the consumer experience is good.

BRIEF DESCRIPTION OF THE DRAWINGS

In order to more clearly illustrate the technical solutions in the embodiments of the present disclosure or prior art, the accompanying drawings to be used in the description of the embodiments or prior art will be briefly introduced below, and it will be obvious that the accompanying drawings in the following description are only some of the embodiments of the present disclosure, and that for ordinary technical personnel in this field, other accompanying drawings can be obtained based on these accompanying drawings without any creative effort.

DETAILED DESCRIPTION OF THE PREFERRED EMBODIMENT

The technical solutions in the embodiments of the present disclosure will be described clearly and completely in the following in conjunction with the accompanying drawings in the embodiments of the present disclosure, and it is obvious that the described embodiments are only a part of the embodiments of the present disclosure, but not all of the embodiments. Based on the embodiments in the present disclosure, all other embodiments obtained by an ordinary person skilled in the art without any creative effort fall within the scope of protection of the present disclosure.

Embodiment 1

Figure 1:
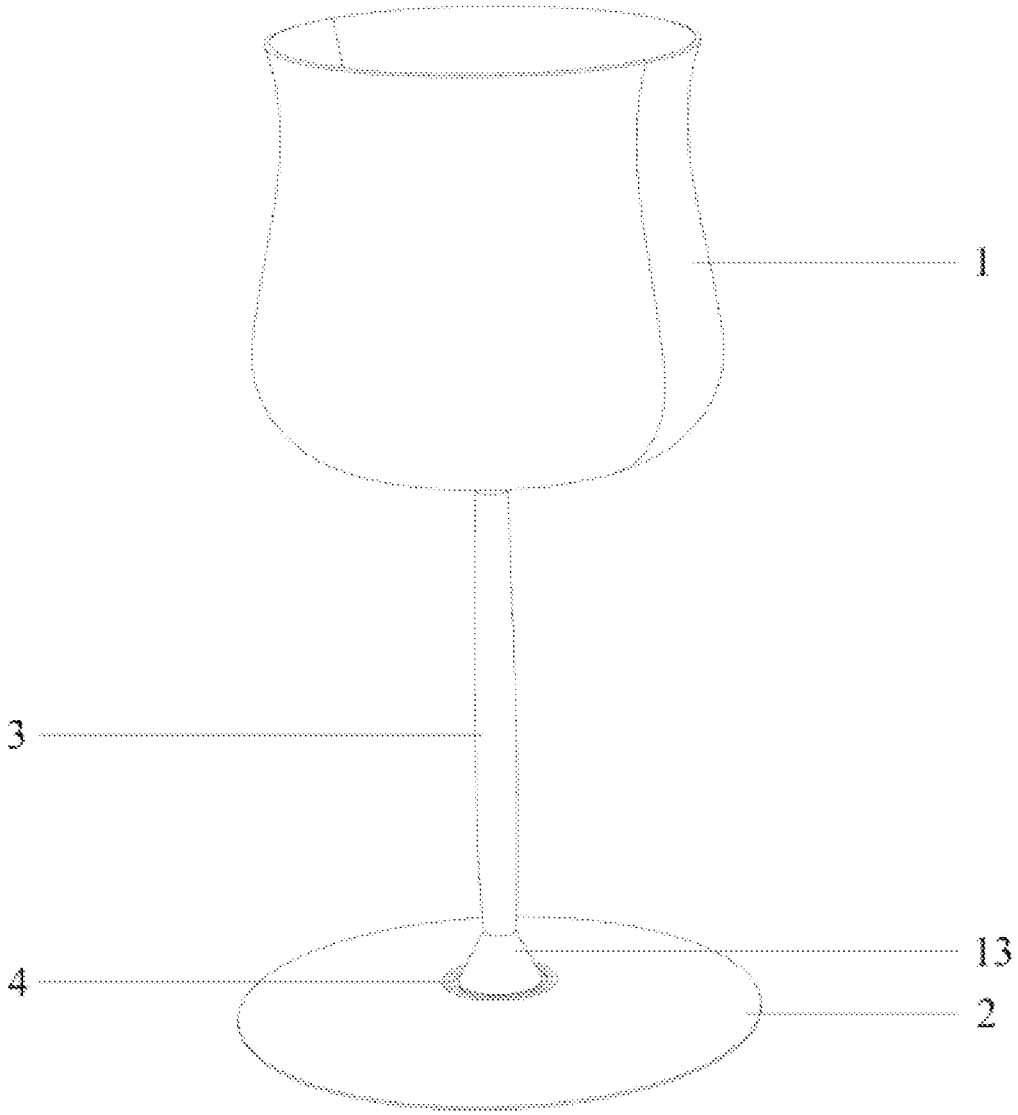
FIG. 1 shows a schematic view of the structure of the rotary goblet in Embodiment 1 of the present disclosure.
Figure 2:
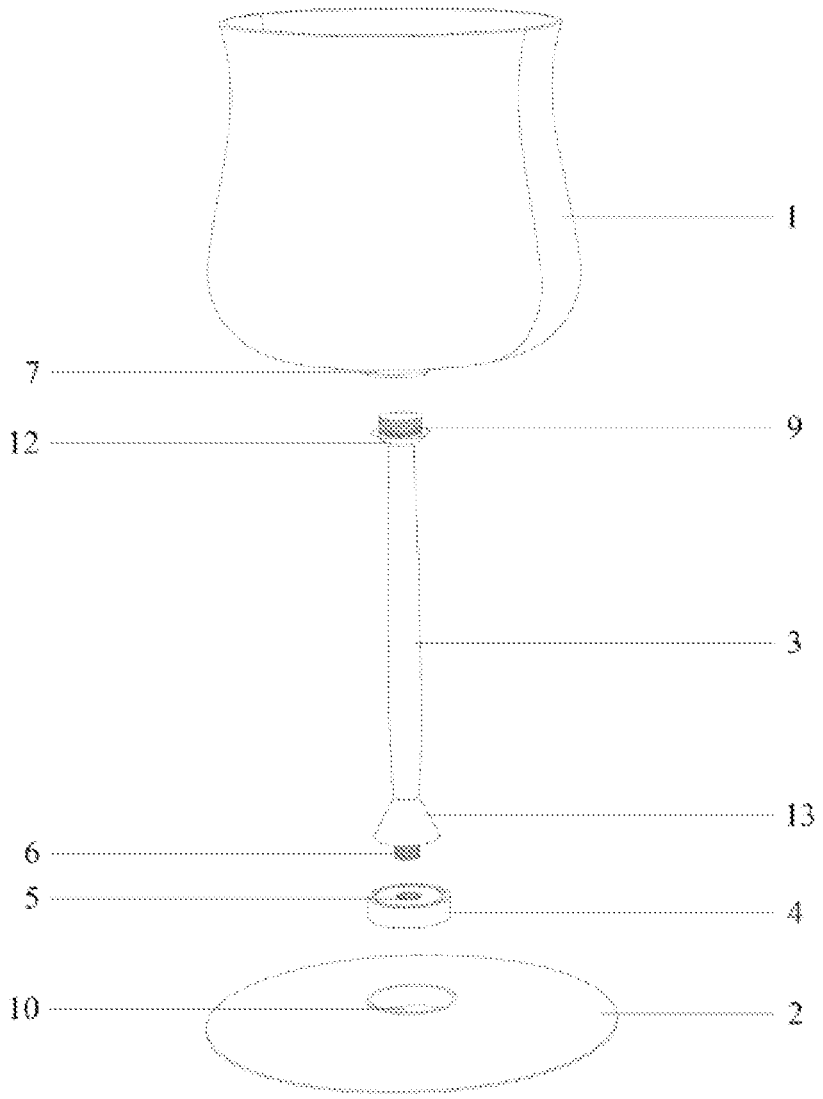
FIG. 2 shows a structural exploded view in a first direction of the rotary goblet in embodiment 1 of the present disclosure.
Figure 3:
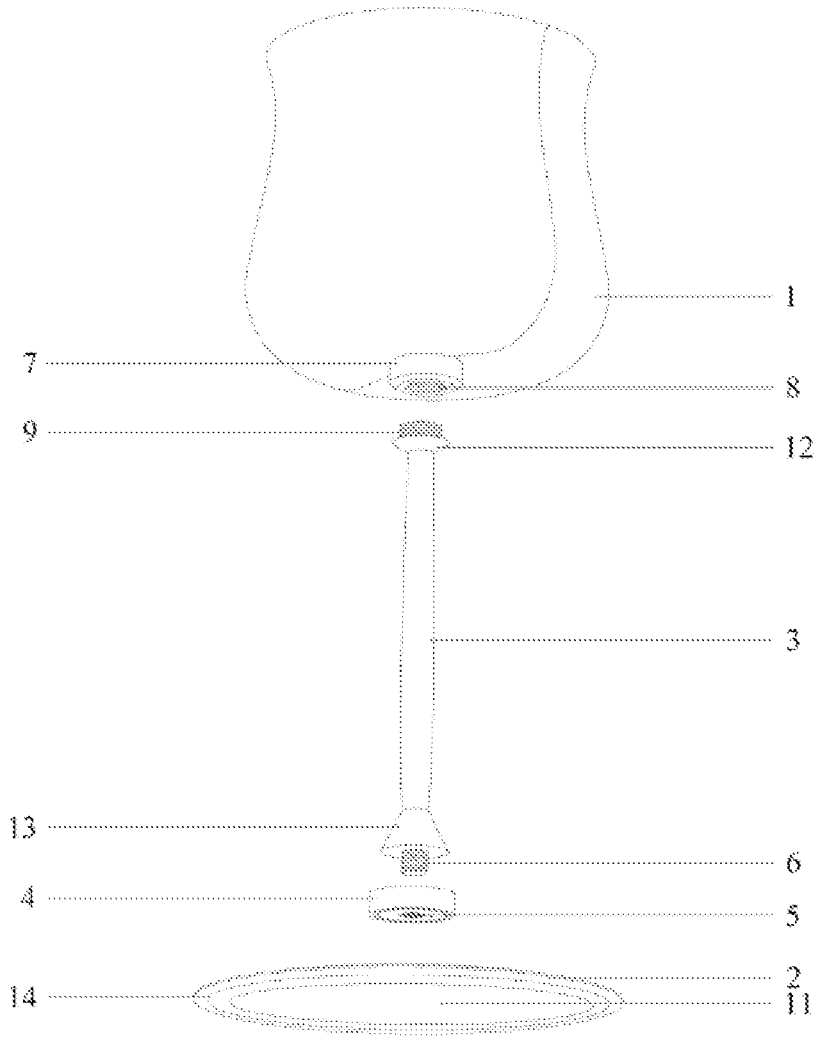
FIG. 3 shows a structural exploded view in a second direction of the rotary goblet in embodiment 1 of the present disclosure.

As shown in FIGS. 1 to 3 a rotary goblet of the present disclosure includes a goblet body 1 and a base 2, a connecting rod 3 is screwed to the bottom of the goblet body 1, a bearing 4 is mounted on the top of the base 1, an inner thread 5 is provided on the inner side of the inner ring of the bearing 4, and an outer thread 6 is provided on the outer side of the bottom of the connecting rod 3 that corresponds to the inner thread 5, and the bottom of the connecting rod 3 is screwed to the inner side of the inner ring of the bearing 4. By means of that a bearing 4 is mounted on the top of the base 2, an inner thread 5 is provided on the inner side of the inner ring of the bearing 4, and an outer thread 6 is provided on the outer side of the bottom of the connecting rod 3 that corresponds to the inner thread 5, and the connecting rod 3 is screwed to the inner side of the inner ring of the bearing 4 at the bottom, so that the connecting rod 3 and the goblet body 1 can be rotated together, and the goblet is rotated and the inertia is utilized to realize that the goblet is rotated on the desktop to wake up the wine automatically When it is necessary to shake the liquid in the goblet body 1. The goblet does not need to be tilted to achieve the effect of automatic rotation of the goblet. By hard rotation of the goblet, there will be no goblet tipping situation, and the goblet is simple in structure, smooth in placement, smooth in rotation and stable in rotation, the goblet body 1 can also be placed flat on the desktop as a normal goblet, which can be used for both purposes and meets the diverse needs of users. It is easy to operate, easy to use, the consumer experience is good.

The bottom of the goblet body 1 is mounted with a connecting seat 7, the inner side of the connecting seat 7 is provided with an internal threaded hole 8, and the top of the connecting rod 3 is provided with a threaded column 9 corresponding to the internal threaded hole 8, which facilitates the screw connection between the connecting rod 3 and the goblet body 1, and makes disassembly and installation more convenient.

In specific embodiments, the bearing 4 is affixed to the top of the base 1, which facilitates quick and solid installation of the bearing 4.

The connecting seat 7 is affixed to the bottom of the goblet body 1, facilitating quick and solid installation of the connecting seat 7.

The top of the base 1 is provided with a mounting hole 10 for positioning and installation of the bearing 4, which facilitates the positioning and installation of the bearing 4, making the installation of the bearing 4 more stable and the rotation of the goblet smoother and more stable.

As a specific implementation, the connecting seat 7 is a metal connecting seat, and the connecting rod 3 is a metal connecting rod, so that the connecting rod 3 is more conveniently installed and more securely installed.

In a specific implementation, the bottom of the inner ring of the bearing 4 and the bottom of the base 2 are provided with corresponding mounting and positioning holes 11, and a pin is inserted into the corresponding mounting and positioning holes 11 during the installation to prevent the relative rotation of the inner ring of the bearing 4 and the connecting rod 3 when they are screwed and installed.

The top of the connecting rod 3 is provided with an upper support portion 12 that gradually becomes larger from the bottom to the top, increasing the contact area between the top of the connecting rod 3 and the connecting seat 7 or the goblet body 1, and improving the solidity of the connection of the top the connecting rod 3.

The bottom of the connecting rod 3 is provided with a lower support portion 13 that gradually becomes larger from top to bottom, increasing the contact area between the bottom of the connecting rod 3 and the base 2, and improving the solidity of the connection of the bottom of the connecting rod 3.

The bottom of the base 2 is provided with an anti-slip pattern, and the anti-slip pattern plays the role of anti-slip, so that the goblet is placed more smoothly.

In the specific implementation, the bottom of the connecting rod 3 can also be snap-fitted to the inner side of the inner ring of the bearing 4, so that the goblet is simple in structure, smooth in placement, smooth in rotation, and stable in rotation.

Embodiment 2

Figure 4:
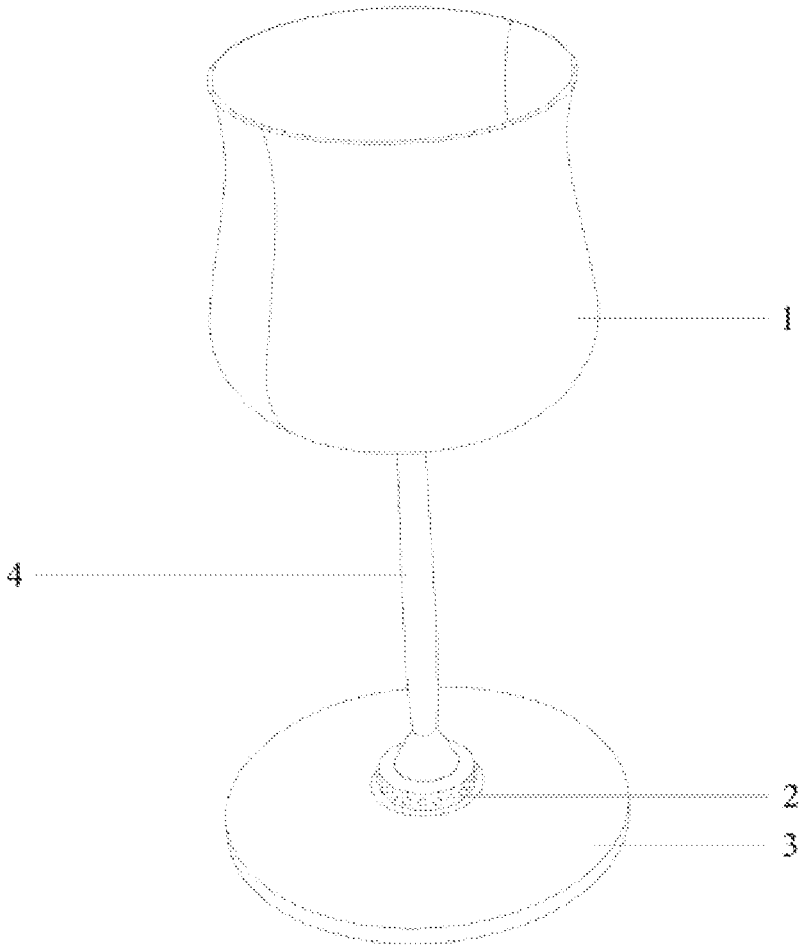
FIG. 4 shows a schematic view of the structure of the rotary goblet in embodiment 2 of the present disclosure.
Figure 5:
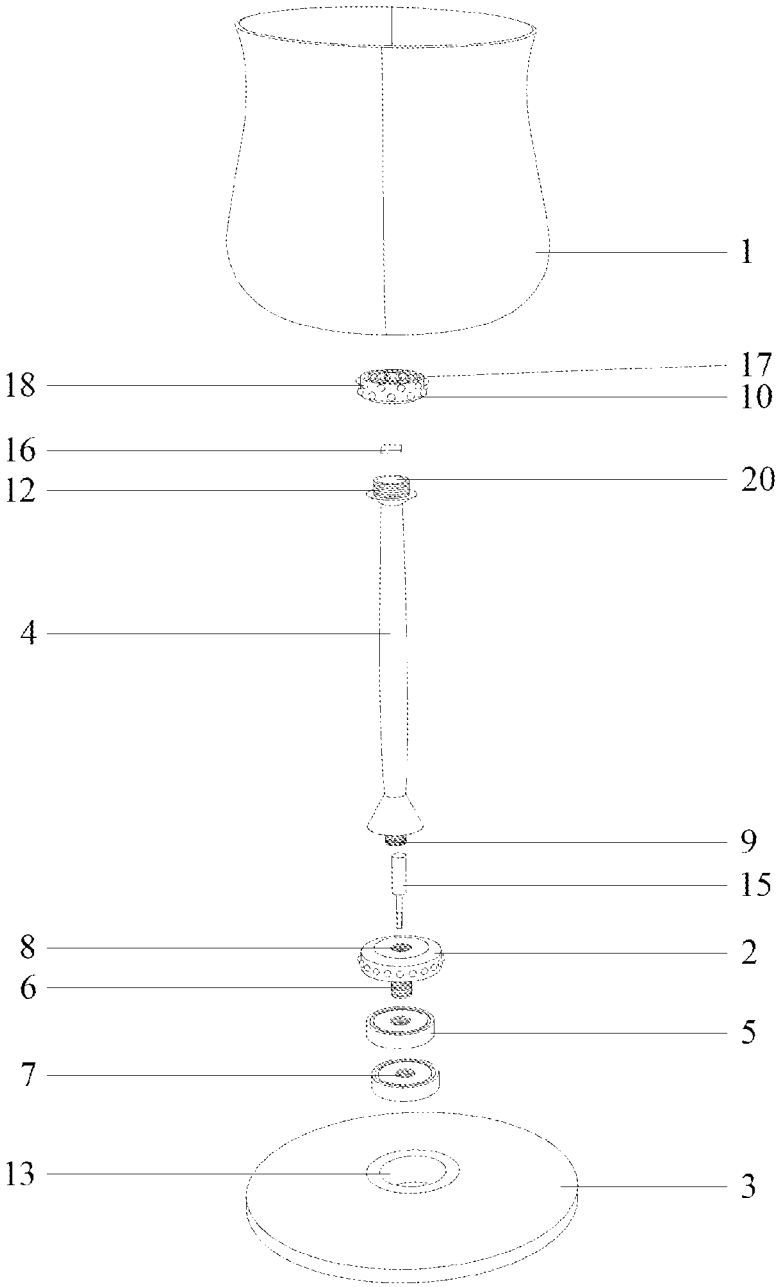
FIG. 5 shows a structural exploded view in a first direction of the rotary goblet in embodiment 2 of the present disclosure.
Figure 6:
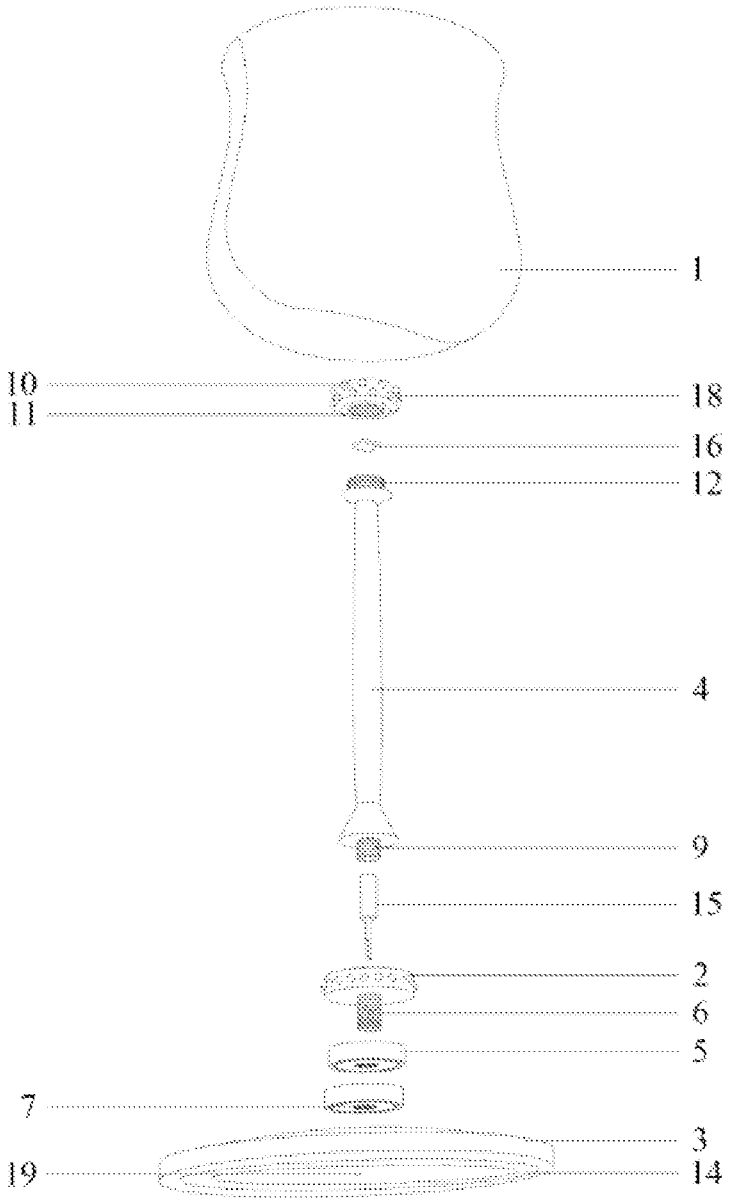
FIG. 6 shows a structural exploded view in a second direction of the rotary goblet in embodiment 2 of the present disclosure.

As shown in FIGS. 4 to 6 the present disclosure discloses a rotary goblet comprising a goblet body 1, a lower connecting seat 2 and a base 3, a connecting rod 4 is screwed to the bottom of the goblet body 1, a number of bearings 5 are mounted on the inner side of the base 3, a connecting screw rod 6 is provided on the bottom of the lower connecting seat 2, the inner side of the inner ring of the bearings 5 is provided with internal threads 7 corresponding to the connecting screw rod 6 and the connecting screw rod 6 is screwed to the inner side of the inner ring of the bearings 5. The top of the lower connecting seat 2 is provided with the inner thread 8 of the lower connecting seat, the outer side of the bottom of the connecting rod 4 is provided with the lower threaded column 9 corresponding to the inner thread 8 of the lower connecting seat, the bottom of the connecting rod 4 is screwed to the inner side of the top of the lower connecting seat 2, and the bottom of the goblet body 1 is installed with an upper connecting seat 10 which is connected with the connecting rod 4. By means of that a number of bearings 5 are installed in the inner side of the base 3, the bottom of the lower connecting seat 2 is provided with the connecting screw rod 6, and the connecting screw rod 6 is screwed to the inner side of the inner ring of the bearing 5, the top of the lower connecting seat 2 is provided with a lower connecting seat internal thread 8, and the bottom of the connecting rod 4 is screwed on the inner side of the top of the lower connecting seat 2, so that the lower connecting seat 2, the connecting rod 4 and the goblet body 1 can be rotated together, and when it is necessary to shake the liquid in the goblet body 1, the goblet is rotated and the inertia is utilized to realize that the goblet is rotated on the tabletop to wake up wine automatically, and the goblet is rotated automatically without tilting, and rotating the goblet with force, there will be no goblet tipping situation, and the goblet is simple in structure, smooth in placement, smooth in rotation and stable in rotation, the goblet body 1 can also be placed flat on the desktop as a normal goblet, which can be used for both purposes and meets the diverse needs of users. It is easy to operate, easy to use, the consumer experience is good.

The inner side of the upper connecting seat 10 is provided with an upper connecting seat internal threaded hole 11, and the top of the connecting rod 4 is provided with an upper threaded column 12 corresponding to the upper connecting seat internal threaded hole 11, which facilitates the screw connection between the connecting rod 4 and the goblet body 1, and makes disassembling and assembling more convenient.

In specific embodiments, the bearing 5 is affixed to the inner side of the base 3, facilitating fast and stable installation of the bearing 5, and the upper connecting seat 10 is affixed to the bottom of the goblet body 1, facilitating fast and stable installation of the upper connecting seat 10.

The inner side of the base 3 is provided with mounting holes 13 for the positioning and installation of the bearing 5, which facilitates the positioning and installation of the bearing 5, so that the bearing 4 can be installed more securely, and the goblet can be rotated more smoothly and more stably.

The bottom of the base 3 is provided with an anti-slip pattern 14, and the anti-slip pattern 14 plays the role of anti-slip, so that the goblet is placed more smoothly.

A generator 15 is mounted on the inner side of the bottom of the connecting rod 4, the generator shaft of the generator 15 is connected to the base 3, a light bead 16 is mounted on the top of the connecting rod 4 which electrically connected to the generator 15, the top of the upper connecting seat 10 is open, the generator shaft of the generator 15 is connected to the stator without rotating, and the rotor of the generator 15 rotates with the generator shell, generating electrical energy to supply the light bead 16, and the light emitted upwardly from the light bead 16 illuminates the bottom of the goblet body 1, and the wine or water within the goblet body 1 appears more aesthetically pleasing.

The outer side of the upper connecting seat 10 is provided with a number of light-transmitting holes 17, and the light-transmitting holes 17 are fitted with light-transmitting decorative members 18, so that the side of the upper connecting seat 10 can emit light, and so that the rotary goblet has a more beautiful appearance.

The lower portion of the base 3 is provided with a generator shaft mounting hole 19 for the generator shaft of the generator 15 to be fixedly mounted, which facilitates the alignment mounting of the generator 15, and at the same time prevents the stator connected to the generator shaft of the generator 15 from rotating, so as to make generating electrical energy more stable.

The inner side of the connecting rod 4 is hollow, and the top of the connecting rod 4 is provided with a mounting groove 20 for the installation of the light bead 16, which is convenient for the stable installation of the light bead 16 and the connection to electricity.

As a specific implementation, the number of bearings 5 is two or more, so that the lower connecting seat 2 is installed more stably and the rotary goblet rotates more smoothly. As a specific embodiment, the number of bearings 5 is two, saving cost while the rotary goblet rotates smoothly.

Embodiment 3

Figure 7:
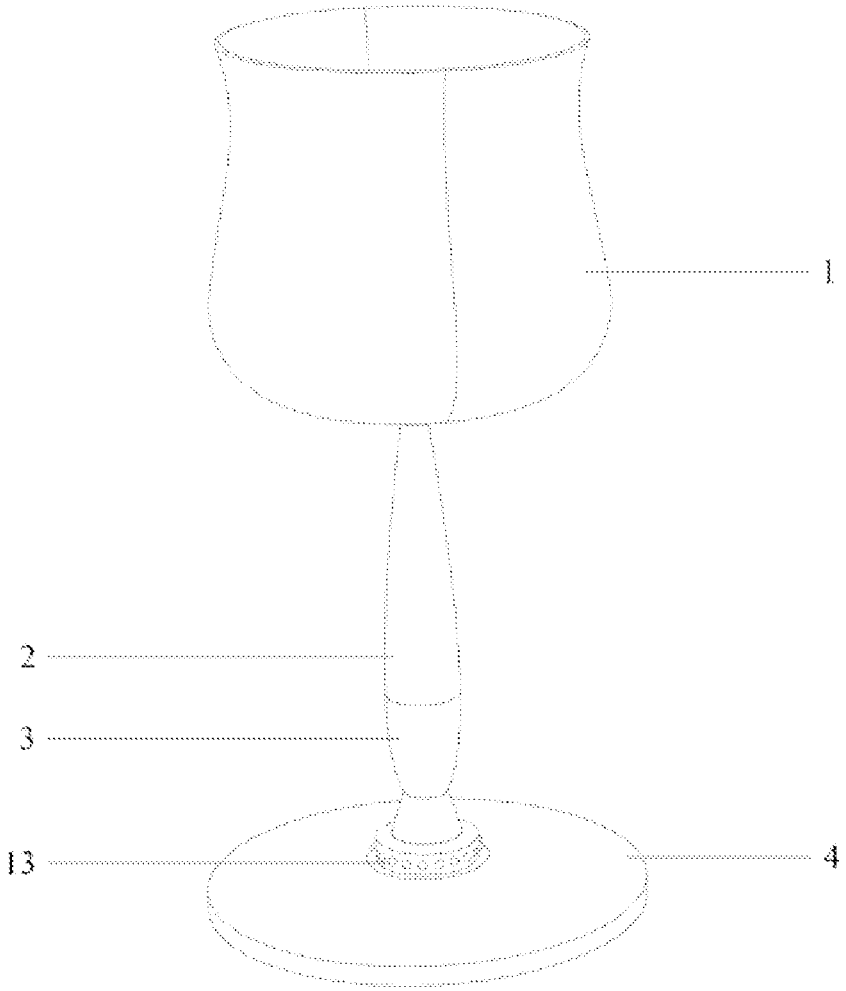
FIG. 7 shows a schematic view of the structure of the rotary goblet in embodiment 3 of the present disclosure.
Figure 8:
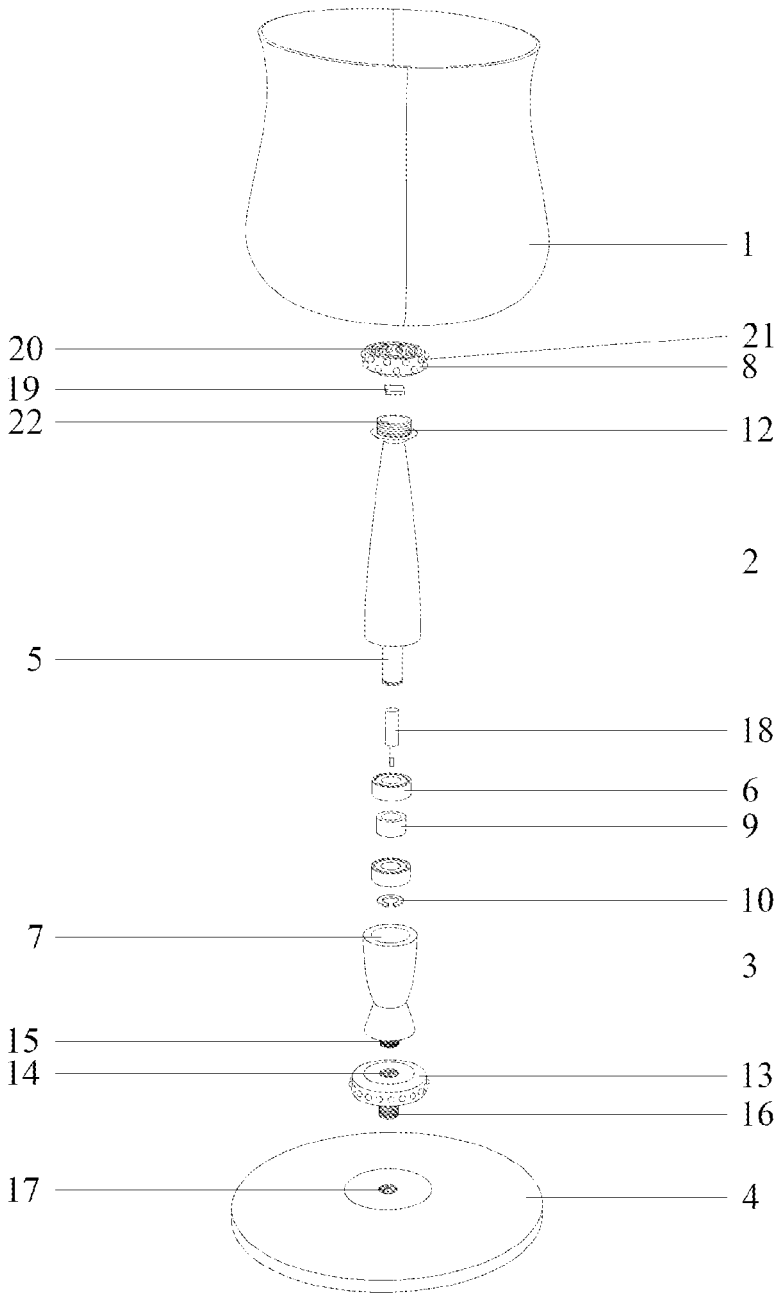
FIG. 8 shows a structural exploded view in a first direction of the rotary goblet in embodiment 3 of the present disclosure.
Figure 9:
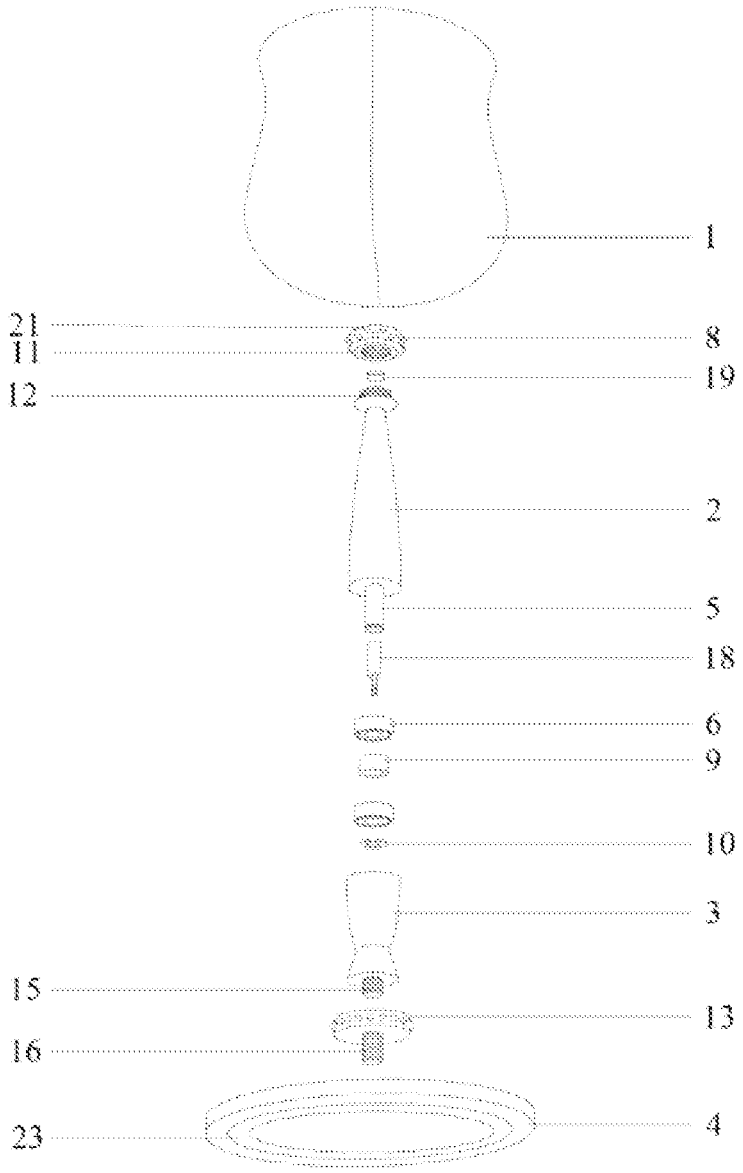
FIG. 9 shows a structural exploded view in a second direction of the rotary goblet in embodiment 3 of the present disclosure.

As shown in FIGS. 7 to 9 the present disclosure discloses a rotary goblet comprising a goblet body 1, an upper connecting rod 2, a lower connecting rod 3 and a base 4, the top of the upper connecting rod 2 is screwed to the bottom of the goblet body 1, the bottom of the lower connecting rod 3 is screwed to the top of the base 1, a sleeve column 5 is provided at the bottom of the upper connecting rod 2, a number of bearings 6 are sleeved on the outer side of the sleeve column 5, a sleeve hole 7 for the installation of the bearing 6 is provided at the top of the lower connecting rod 3, the outer ring of bearing 6 is fixedly connected with the top of lower connecting rod 3, the inner ring of bearing 6 is fixedly connected with the sleeve column 5, the bottom of goblet body 1 is installed with an upper connecting seat 8 which is connected with upper connecting rod 2. By means of that the top of upper connecting rod 2 is screwed to the bottom of goblet body 1, the bottom of lower connecting rod 3 is screwed to the top of base 4, the bottom of upper connecting rod 2 is equipped with a sleeve column 5, the outside of sleeve column 5 is sleeved equipped with a number of bearings 6, the top of lower connecting rod 3 is equipped with a sleeve hole 7 for the installation of the bearings 6, the outer ring of the bearings 6 is fixedly connected to the top of the lower connecting rod 3, and the inner ring of the bearings 6 is fixedly connected to the sleeve column 5, so that the upper connecting rod 2, the upper connecting seat 8 and the goblet body 1 can be rotated together, and when it is necessary to shake the liquid in the goblet body 1, the goblet is rotated and the inertia is utilized to realize that the goblet is rotated on the tabletop to wake up wine automatically, and the goblet is rotated automatically without tilting, and rotating the goblet with force, there will be no goblet tipping situation, and the goblet is simple in structure, smooth in placement, smooth in rotation and stable in rotation, the goblet body 1 can also be placed flat on the desktop as a normal goblet, which can be used for both purposes and meets the diverse needs of users. It is easy to operate, easy to use, the consumer experience is good.

A sleeve 9 is provided between the bearings 6, so that the rotation between the bearings 6 is not affected, and at the same time the stability of installation of the bearing 6 is improved, the stability and smoothness of the rotation of the goblet is improved. The bottom of the sleeve column 5 is snap-fitted to a card spring 10 against the bearing 6, to facilitate the fixed installation of the bearing 6, to prevent the bearing 6 from loosening and falling off due to vibration.

The inner side of the upper connecting seat 8 is provided with an upper connecting seat internal threaded hole 11, and the top of the upper connecting rod 2 is provided with an upper threaded column 12 corresponding to the upper connecting seat internal threaded hole 11, which is convenient for disassembling and assembling between the upper connecting rod 2 and the upper connecting seat 8.

A lower connecting seat 13 is screwed to the bottom of the lower connecting rod 3, a lower connecting seat internal thread 14 is provided at the top of the lower connecting seat 13, and a lower threaded column 15 corresponding to the lower connecting seat internal thread 14 is provided at the bottom of the lower connecting rod 3, which facilitates disassembly and assembly between the lower connecting rod 3 and the lower connecting seat 13.

A connecting screw rod 16 is provided at the bottom of the lower connecting seat 13, and a base inner threaded hole 17 corresponding to the connecting screw rod 16 is provided at the top of the base 4, and the lower connecting seat 13 is screwed to the base 4, which facilitates disassembly and assembly between the lower connecting seat 13 and the base 4.

A generator 18 is mounted on the inner side of the bottom of the upper connecting rod 2, the generator shaft of the generator 18 is connected to the lower connecting rod 3, the top of the upper connecting rod 2 is mounted with a light bead 19 electrically connected to the generator 18, the top of the upper connecting seat 8 is open, the generator shaft of the generator 18 is connected to the stator without rotating, and the rotor within the generator 18 rotates with the generator shell to generate electrical energy to be supplied to the light bead 19, the light emitted upwardly from the light bead 19 illuminates the bottom of the goblet body 1, and the wine or water within the goblet body 1 appears more aesthetically pleasing.

The outer side of the upper connecting seat 8 is provided with a number of light-transmitting holes 20, and the light-transmitting holes 20 are fitted with light-transmitting decorative members 21, so that the side of the upper connecting seat 8 can illuminate, so that the rotary goblet has a more beautiful appearance.

The upper portion of the lower connecting rod 3 is provided with a generator shaft mounting hole for the generator shaft of the generator 18 to be fixedly mounted, which facilitates the alignment mounting of the generator 18, and at the same time prevents the stator connected to the generator shaft of the generator 18 from rotating, so that the power generation is more stable.

The inner side of the upper connecting rod 2 is hollow, and the top of the upper connecting rod 2 is provided with a mounting groove 22 for the installation of the light bead 19, which is convenient for the stable installation of the light bead 19 and the connection to electricity.

In particular, the outer ring of the bearing 6 is affixed to the top of the lower connecting rod 3, so that the bearing 6 can be installed more stably.

The bottom of the base 4 is provided with an anti-slip pattern 23, and the anti-slip pattern 23 plays the role of anti-slip, so that the goblet is placed more smoothly.

As a specific implementation, the number of bearings 6 is two or more, so that the upper connecting rod 2 is installed more stably and the rotary goblet rotates more smoothly. As a specific implementation, the number of bearings 6 is two, saving costs while the rotary goblet rotates smoothly.

The foregoing are only preferred embodiments of the present disclosure, and are not intended to limit the present disclosure, and any modifications, equivalent substitutions, improvements, etc. made within the spirit and principles of the present disclosure shall be included in the scope of protection of the present disclosure.

What is claimed is:

1. A rotary goblet, characterized in that it comprises a goblet body and a base, a bottom of the goblet body is connected to a connecting rod, a bearing is affixed to a top of the base, and a bottom of the connecting rod is connected to an inner side of an inner ring of the bearing so that the connecting rod is capable of rotating together with the inner ring of the bearing relative to the base, the connecting rod is vertically arranged between the goblet body and the base and is capable of being rotated horizontally with respect to the base by means of the bearing, and the bearing is configured to allow the inner ring of the bearing together with the goblet body and the connecting rod to keep rotating horizontally with respect to the base about a central axis of the connecting rod without tilting, under inertia of rotation of the rotary goblet;

the top of the base is provided with a mounting hole for positioning and mounting of the bearing;

and, a bottom of the inner ring of the bearing and a bottom of the base both are provided with corresponding mounting and positioning holes.

2. The rotary goblet according to claim 1, characterized in that a connecting seat is mounted at the bottom of the goblet body, an internal threaded hole is provided on an inner side of the connecting seat, and a threaded column corresponding to the internal threaded hole is provided at a top of the connecting rod.

3. The rotary goblet according to claim 1, characterized in that the bearing is affixed to the top of the base;

and/or, the inner side of the inner ring of the bearing is provided with an internal thread, and an outer side of the bottom of the connecting rod is provided with an external thread corresponding to the internal thread;

and/or, a top of the connecting rod is provided with an upper support portion that is progressively larger from bottom to top;

and/or, the bottom of the connecting rod is provided with a lower support portion that gradually becomes larger from top to bottom;

and/or, the bottom of the base is provided with a non-slip pattern.

4. The rotary goblet according to claim 2, characterized in that the connecting seat is affixed to the bottom of the goblet body;

and/or, the connecting seat is a metal connecting seat and the connecting rod is a metal connecting rod.

* * * * *